United States Patent [19]

Legatos et al.

[11] Patent Number: 4,826,091

[45] Date of Patent: May 2, 1989

[54] APPARATUS AND METHOD FOR WINDING A WIRE AROUND A STRUCTURE

[75] Inventors: Nicholas A. Legatos, Syosset; Andrew Tripp, Jr., Huntington; Bill R. Bush, West Babylon, all of N.Y.

[73] Assignee: Preload Concrete Structures, Inc., Garden City, N.Y.

[21] Appl. No.: 118,395

[22] Filed: Nov. 6, 1987

[51] Int. Cl.[4] ..... B21F 17/00; B65H 81/00

[52] U.S. Cl. ..... 242/7.02; 242/7.21; 324/425

[58] Field of Search ..... 242/7.21, 7.22, 7.02; 324/425

[56] References Cited

U.S. PATENT DOCUMENTS

| | | | |
|---|---|---|---|
| 2,103,134 | 12/1937 | Akahira . | |
| 2,460,107 | 1/1949 | Slade . | |
| 2,485,871 | 10/1949 | Entwistle . | |
| 2,704,825 | 3/1955 | Martin et al. . | |
| 2,794,169 | 5/1957 | Gooding . | |
| 2,882,492 | 4/1959 | Gooding . | |
| 2,900,597 | 8/1959 | Gooding . | |
| 2,937,336 | 5/1960 | Gooding . | |
| 2,977,531 | 3/1961 | Humes et al. . | |
| 3,040,249 | 6/1962 | Schwarckipf et al. . | |
| 3,096,478 | 7/1963 | Brown . | |
| 3,134,071 | 5/1964 | Wakefield . | |
| 3,241,278 | 3/1966 | Magers, Jr. . | |
| 3,259,893 | 7/1966 | Parker . | |
| 3,343,081 | 9/1967 | Lane . | |
| 3,349,324 | 10/1967 | Wakefield . | |
| 3,364,420 | 1/1968 | Kreuger . | |
| 3,377,757 | 4/1970 | Magers, Jr. . | |
| 3,504,474 | 4/1970 | Dykmans . | |
| 3,579,931 | 9/1969 | Lang . | |
| 3,611,122 | 9/1969 | Pahl, Jr. . | |
| 3,612,994 | 9/1969 | Hooper . | |
| 3,666,190 | 5/1972 | Dykmans | 242/7.21 |
| 3,687,380 | 8/1972 | Magers et al. | 242/7.21 |
| 3,710,241 | 1/1973 | Dineen . | |
| 3,820,011 | 6/1974 | Hoveman . | |
| 3,822,167 | 7/1974 | Piola | 242/7.21 |
| 3,890,566 | 6/1975 | Nordclad et al. . | |
| 3,917,995 | 11/1975 | Clinton . | |
| 4,059,238 | 11/1977 | Vogt | 242/7.21 |
| 4,240,026 | 12/1980 | Murphy et al. . | |
| 4,517,510 | 5/1985 | Clinton . | |
| 4,558,273 | 12/1985 | Nishimura . | |
| 4,659,033 | 4/1987 | Bush et al. . | |

*Primary Examiner*—Stuart S. Levy
*Assistant Examiner*—Katherine Matecki
*Attorney, Agent, or Firm*—Scully, Scott, Murphy & Presser

[57] ABSTRACT

Apparatus and methods for winding a wire around a periphery of a structure. The wire is connected to the structure and then pulled around that structure in a manner that produces a high tension in a portion of the wire and that winds that high tension portion of the wire around the structure. The high tension portion of the wire is monitored to detect any flaws in the wire coating or cover, and the locations of these flaws are recorded.

14 Claims, 3 Drawing Sheets

APPARATUS AND METHOD FOR WINDING A WIRE AROUND A STRUCTURE

BACKGROUND OF THE INVENTION

This invention generally relates to apparatus and methods for winding a wire onto a structure, and more specifically, to apparatus and methods for winding a coated wire under tension around a peripheral wall of a structure to form a pretressed structure.

Prestressed structures often comprise a generally cylindrical concrete wall, with one or more layers of stressed wire wrapped about the cirumference of the wall; and these structures are used for many purposes, such as storage tanks for liquids and gases, silos, and pressure containment chambers. In the construction of such a structure, a steel wire is stressed and then coiled around a cylindrical concrete wall to exert a net compressive force therein, and the wire is then normally embedded in concrete or mortar. The force that the wire exerts on the concrete wall is usually large enough so that when the structure is filled with a fluid, there is always a net compressive force in the structural wall, even though the contents thereof tend to exert a tensive force in the wall.

In order to insure that the steel wire continues to exert the desired compressive force over the lifetime of the structure, it is important to avoid corrosion of the wire, which may be caused by moisture penetration, the source of which is either internal or external to the structure. Various techniques may be used to inhibit this corrosion; and, for example, the wire may be coated with a water resistant material such as polyvinyl chloride, a resin or an-epoxy.

While these coatings effectively inhibit corrosion, it is believed that they may not be completely successful at entirely preventing the corrosion. To elaborate, it has been found that tiny flaws and defects, such as cracks, tears, or other openings, may form in the wire coating during the wire coating process or as the wire is stressed prior to being wrapped around the structure. If these flaws are not fixed, water or other substances may leak inward through the flaws and eventually have a corrosive effect on the steel wire core.

SUMMARY OF THE INVENTION

It is an object of the invention to provide means for overcoming these and other difficulties encountered in the art.

A further object of this invention is to wind a wire under tension around a structure and to locate and record any damage that may be done to the wire coating prior to or during tensioning of the wire.

Another object of this invention is to wind a wire under tension around a structure, to record on a chart the tension of the wire as it is wound onto the structure, and to record on that same chart the location of any defects or flaws in the wire coating.

These and other objects are attained with apparatus for winding a wire around the periphery of a structure, and comprising tensioning means, flaw detecting means, and recording means. The tensioning means is provided to tension wire from a wire supply; and this tensioning means includes means for holding the wire supply, means for stressing the wire, and means for driving the tensioning means around the periphery of the structure. In use, the tensioning means separates the wire into a lower tension portion extending between the wire supply and the stressing means, and a higher tension portion extending between the stressing means and the structure.

The flaw detecting means receives the higher tension portion of the wire from the tensioning means and senses flaws in the wire coating along that higher tension portion, and the recording means is connected to the flaw detecting means to record the location of these flaws. Preferably, the apparatus further includes wire marking means located adjacent the higher tension portion of the wire and connected to the flaw detecting means to mark the wire coating itself adjacent the flaws therein.

Means may be provided to measure the tension of the higher tension portion of the wire and to record this measured tension. For example, a chart may be provided having an axis representing the length of the wire, and the tension of the wire along its length may be recorded on this chart along this axis. With this preferred embodiment, the means to record the location of the flaws in the wire coating may include means to mark this same chart along the above-mentioned axis thereof.

Further benefits and advantages of the invention will become apparent from a consideration of the following detailed description, given with reference to the accompanying drawings, which specify and show preferred embodiments of the invention.

DETAILED DESCRIPTION OF THE PREFERRED EMBODIMENTS

Figure 1:
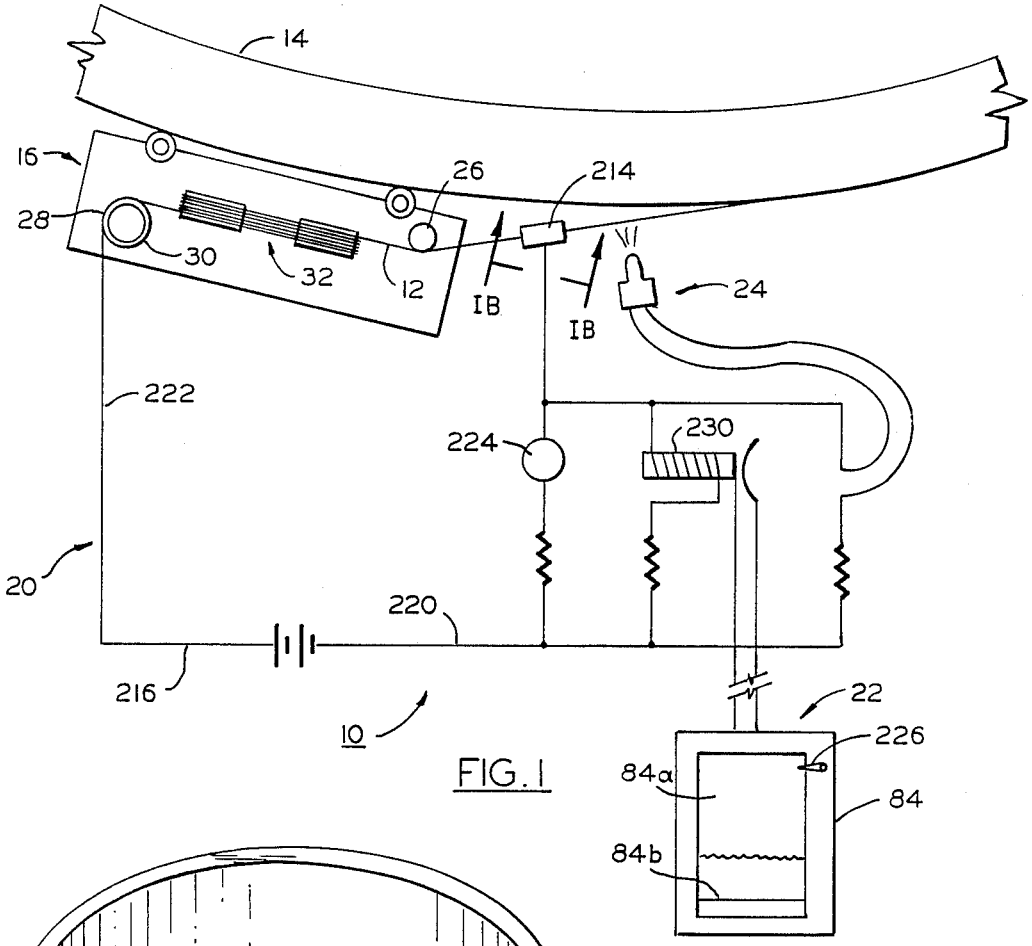
FIG. 1 is a schematic drawing illustrating wire winding apparatus in accordance with this invention.

FIG. 1 shows apparatus 10 for winding a wire 12 around the periphery of a structure, schematically represented, in part, at 14; and generally apparatus 10 includes wire tensioning means 16, flaw detecting means 20, and recording means 22, and preferably apparatus 10 further includes wire marking means 24 and tension measuring means 26. Generally, tensioning means 16 is provided to tension wire 12, and the tensioning means includes means 28 for holding a wire supply 30, means 32 for stressing the wire, and means (discussed in detail below) for driving the tensioning means 16 about the periphery of the structure 14. Flaw detecting means 20 is provided to receive a tensioned portion of the wire 12 from tensioning means 16 and to sense or detect flaws such as cracks or openings in the coating of the wire along that tensioned portion, and recording means 22 is connected to the flaw detecting means to record the location of the flaws in the wire coating. Wire marking means 24 is located adjacent the tensioned portion of the wire and is connected to flaw detecting means 20 to mark the wire coating adjacent the flaws therein, and measuring means 26 is provided to measure the tension of the tensioned portion of the wire.

Figure 1B:
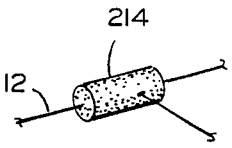
FIG. 1*b* is taken along line 1*b*—1*b* of FIG. 1 and shows a part of a flaw detecting means of the wire winding apparatus.
Figure 1A:
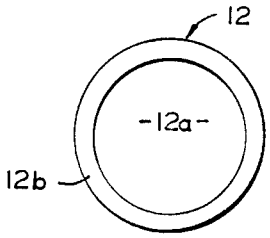
FIG. 1*a* is an end view of a wire that may be used with the wire winding apparatus.

With reference to FIG. 1*a*, wire 12 has an internal, electrically conductive core 12*a* and an outside, electrically nonconductive coating or cover 12*b*; and any suitable such wire may be employed in the practice of this invention, although preferably wire 12 comprises a single strand steel wire core having an epoxy coating. Normally, this steel wire core has a diameter between 0.162 and 0.192 inches and a suitable wire is manufactured by the Florida Wire and Cable Company under the names Flo-Gard and Flo-Bond.

The epoxy coating 12*b* on the wire is significantly less permeable to oxygen and water than plastic materials such as polyvinyl chloride, and thus provides improved protection against oxidation of the steel wire core 12*a* over time. Epoxy also has superior resistance to chloride ion permeation, and this feature can be of significant value in marine and seaboard locations. The epoxy coating is much more flexible than, and thus takes lateral stresses much better than, polyvinyl chloride, which can tear under the radial forces exerted between the wire 12 and structure 14 when the wire is stressed over that structure. Another significant advantage of using epoxy coated wire is that it eliminates the need to use separate means such as a steel water barrier diaphragm, to prevent water penetration into the outside wall of structure 14. Also, as epoxy is not a thermoplastic, it will resist melting much better than other resin materials.

While it is preferred to use a previously coated wire 12 and to apply that wire onto structure 14, it is also possible to use uncoated or bare wire, and to apply a quick curing epoxy to that bare wire. In this case, the epoxy coating would cure while the wire is under tension between the tensioning means 16 and the structure 14. Furthermore, the coated wire can optionally include a gritty covering to improve bonding between the wire and mortar concrete.

Tensioning means 16 is described in detail in U.S. Pat. No. 4,659,033, which is herein incorporated by reference. FIGS. 2–8 also show tensioning means 16, and how it is used; and with particular reference to FIGS. 2–5, it will be seen that the tensioning means includes a carriage 34 that, in use, is suspended by cables 36 from an overhead trolley or carriage 40 which travels on rollers 42 about the upper rim of concrete structure 14. Tensioned wire 12 is wrapped around the periphery of the concrete structure 14 at a predetermined spacing by raising or lowering carriage 34. With the embodiment shown in FIGS. 2–5, carriage 34 can be raised or lowered on cables 36 which pass through pulleys 44 attached to hooks 46, which in turn pass through eye bolts provided on the carriage.

Figure 2:
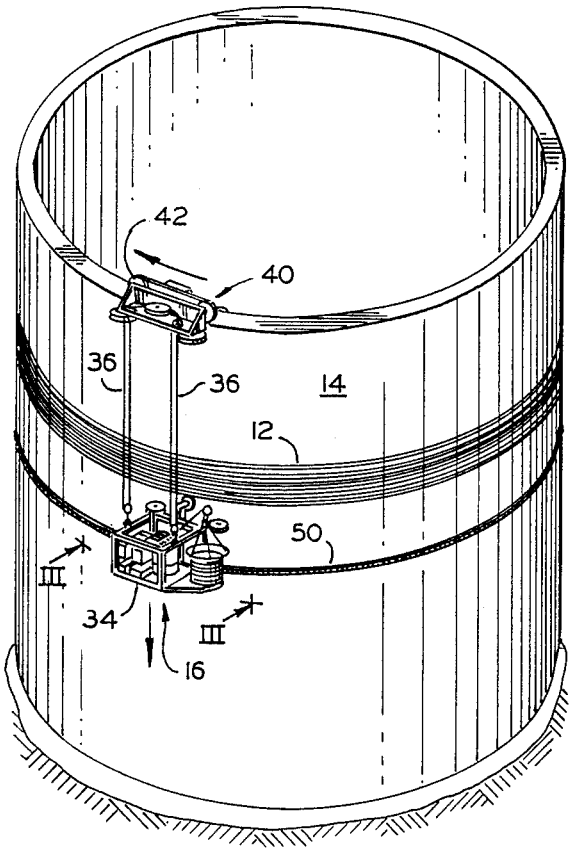
FIG. 2 shows the apparatus of the present invention as it is employed to wrap a tensioned wire around a structure.

Movement of carriage 34 around structure 14 is guided by drive chain 50, which is placed about the periphery of the concrete structure. As will subsequently be described in greater detail, tensioning means 16 may include driving means mounted on carriage 34 to propel this carriage about concrete structure 14. Alternatively, an independent driving means such as a tractor or second carriage preceding or following carriage 34 may be used to propel the carriage 34. Also, although FIG. 2 shows carriage 34 suspended from an overhead carriage support 40, the carriage 34 may also be supported by a framework which rides on the ground and travels about the periphery of concrete structure 14.

Figure 3:
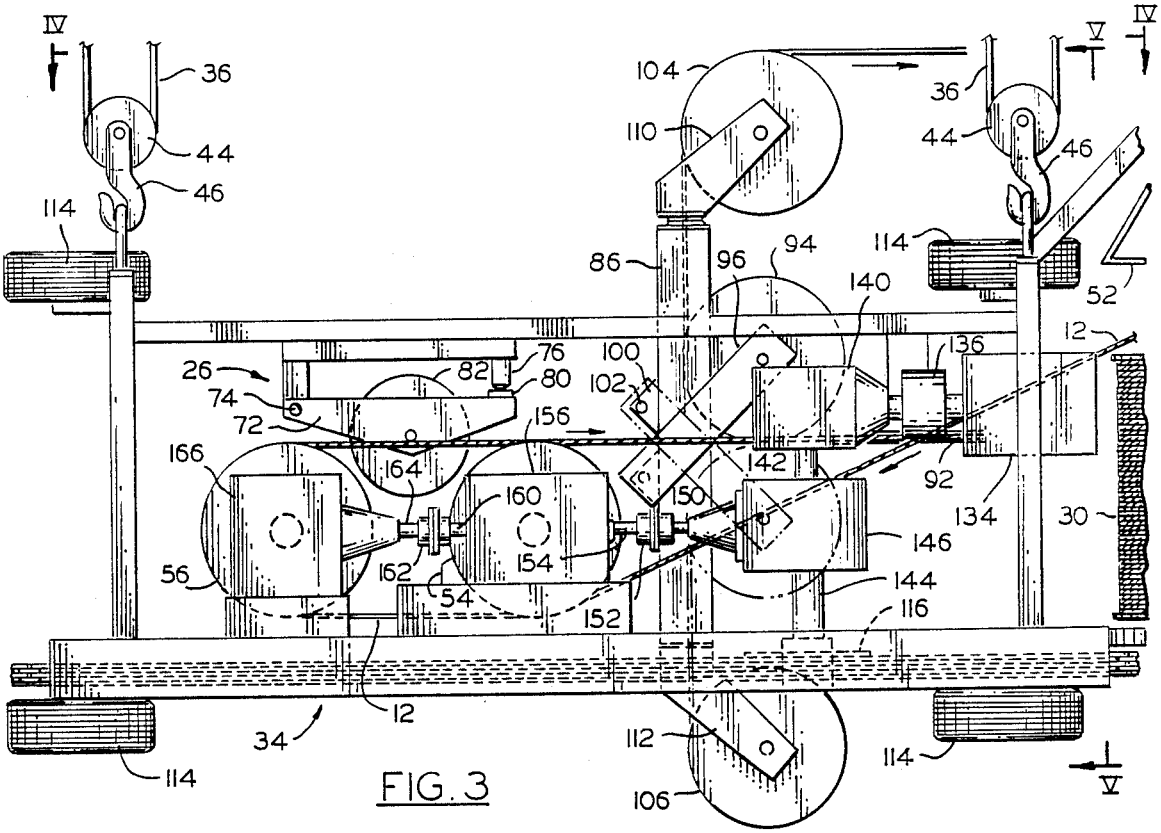
FIG. 3 is a view of the wire tensioning means of the wire winding apparatus of FIGS. 1 and 2, taken along line III—III of FIG. 2.
Figure 4:
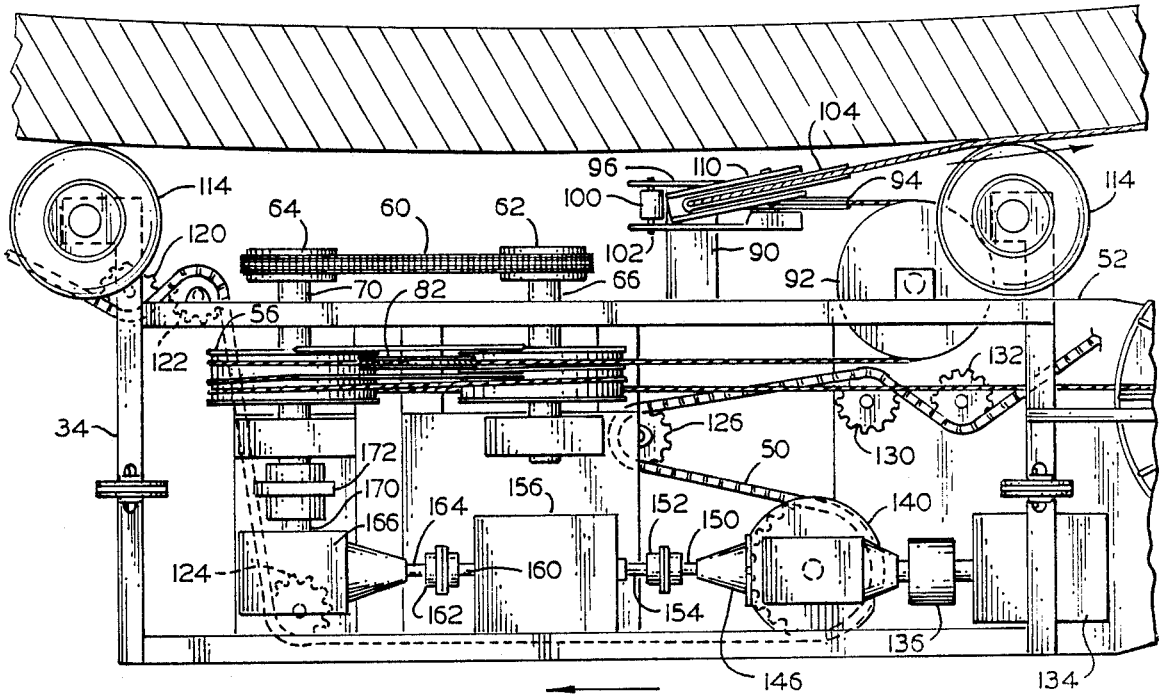
FIG. 4 is a top view of the wire tensioning means, taken along line IV—IV of FIG. 3.
Figure 5:
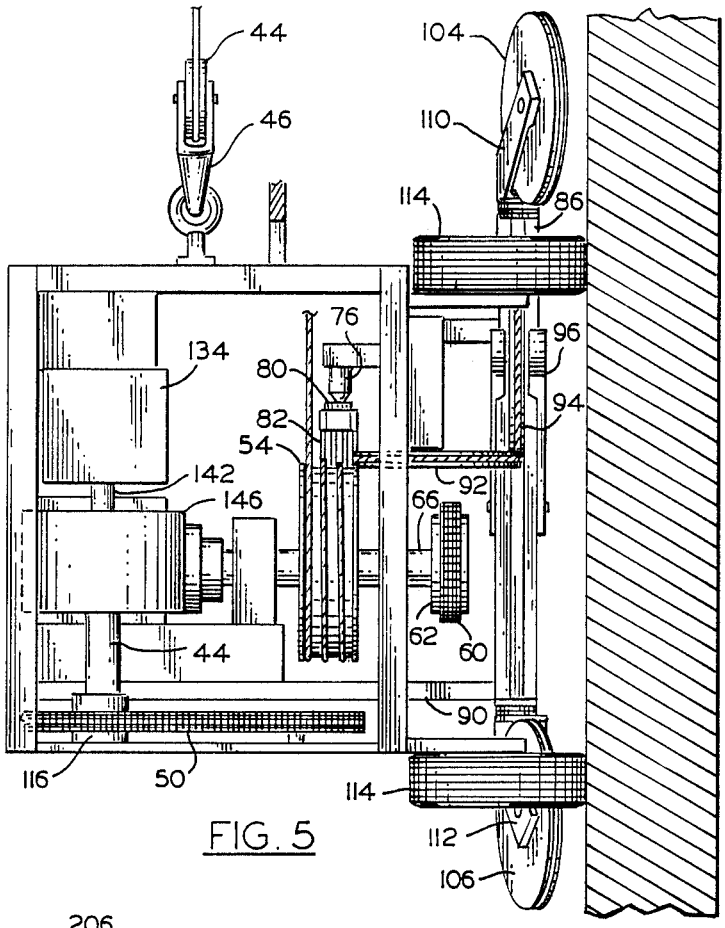
FIG. 5 is a side view, partially in cross section, of the wire tensioning means, taken along line V—V of FIG. 3.

Referring now to FIGS. 3–5, untensioned wire 12 is unwrapped from wire supply 30 (partially shown in FIG. 3) by wire supply payoff means 52 (partially shown in FIG. 3), and the wire 12 either passes directly to first and second stress wheels 54 and 56 or may be guided to the stress wheels by a direction sheave (not shown) which deflects the wire as it is released by the payoff means 52. The untensioned wire 12 passes under first stress wheel 54 and to the second stress wheel 56, partially encircles the second stress wheel and passes therefrom back to the first stress wheel. It then partially encircles first stress wheel 54 and is passed back to second stress wheel 56, and this process is repeated a number of times until sufficient friction develops between the stress wheels 54 and 56 and the wire 12 so that the wire does not slip on the stress wheels. The number of times the wire 12 passes from stress wheel 54 to stress wheel 56 varies in accordance with the coefficient of friction between the stress wheels and the wire, the tension to be placed on the wire, and many other factors. A preferred number of passes about stress wheels 54 and 56 is between 4 and 12, with an optimal range being between 6 and 8.

With this preferred arrangement, wire 12 wraps around the two stress wheels 54 and 56 together but does not fully encircle any one stress wheel. Also, as shown in FIG. 3, untensioned wire 12 passes below stress wheels 54 and 56; however, as will be understood by those of ordinary skill in the art, the untensioned wire can pass either above or below stress wheels 54 and 56 on its first pass, as long as the other elements of the system are arranged to accommodate this. Stress wheels 54 and 56 are connected together so that these wheels rotate at the same speed. For instance, this unitary rotation may be achieved by means of a governor chain 60 mounted on sprockets 62 and 64 that are respectively directly connected to wheels 54 and 56 by shafts 66 and 70.

The wire 12, on its last wrap around the stress wheels, after it disengages from stress wheel 56 and before it engages stress wheel 54, contacts the tension measuring means or tensiometer 26. The tensiometer 26 includes a pivot bar 72 which pivots about bolt 74, a load cell 76, and a contact pad 80 mounted at one end of the pivot bar 72 and which contacts the load cell 76. The tensiometer 26 also has a center sheave 82 rotatably mounted centrally on pivot bar 72. The center sheave 82 contacts the wire 12 which is now under tension after having been wrapped around stress wheels 54 and 56 several times, and the wire exerts a force on center sheave 82 and causes contact pad 80 to contact load tensiometer 26 should be positioned in relation to stress wheels 54 and 56 so that the wire 12, on its last wrap around the stress wheels, is slightly deflected; and as shown in FIG. 3, center sheave 82 is disposed between and slightly above stress wheels 54 and 56.

The force exerted on load cell 76 by pad 80 is proportional to the tension in the wire 12 before it is paid off from the tensioning means 16 and onto the wall of the concrete structure 14, and this force is recorded on a recording means and may also be used to automatically control the tension in the wire 12 by use of an appropriate electronically actuated device. Any suitable means may be used to record the tension of wire 12, and, for instance, this tension may be recorded in a conventional manner on a conventional strip chart recorder, shown at 84 in FIG. 1. Recorder 84 has a moving chart 84*a* which in turn has an axis 84*b* representing the length or longitudinal dimension of wire 12; and as the tensioned wire 12 moves past sheave 82, the tension of the wire is continuously recorded on chart 84*a* along axis 84*b*.

After exiting the center sheave 82 of the tensiometer 26, the wire 12 contacts stress wheel 54 and exits therefrom, and the tensioned wire is now directed to a tensioned wire payout device. This payout device includes a vertically disposed post 86, which is adjustably mounted on carriage 34 by carriage extension 90 and which extends above and below the carriage. The means for adjusting the height of vertical post 86 may include two C brackets (not shown) between which the vertical post 86 passes, and a bolt (not shown) which passes through the ends of the C brackets so that the C brackets may be tightened together and wedge the vertical post at the desired height. The C brackets and end bolt may comprise a part of carriage extension 90 or may be situated elsewhere. Other means of adjusting the height of vertical post 86 may be employed, such as a mounting bracket which surrounds the vertical post as it passes through the floor of the carriage 34. Post 86 may be connected to such a mounting bracket by means of a locking set screw which passes through the mounting bracket and contacts the vertical post 86 with sufficient pressure to keep it at its selected height.

A horizontally disposed sheave 92 is mounted either to the vertical post 86 or to the carriage 34. The tensioned wire 12, as it passes from stress wheel 54 after its last wrap, is directed to sheave 92, which changes the direction of the wire and feeds it to center sheave 94, which is adjustably mounted on the vertical post 86. Center sheave 94 is vertically disposed and mounts to vertical post 86 by bracket 96, and this bracket is affixed to the vertical post by a pin that passes through post 86. A triangular shaped wedge 100 is connected to one end of bracket 96 by pin 102. One side of wedge 100, preferably the longer or hypotenuse side of the triangular shaped wedge, contacts a side of vertical post 86, and the interaction of the wedge and pin 102 allows bracket 96 to be placed in a position either above or below direction sheave 92. Thus, the tensioned wire 12, as it exits direction sheave 92, will contact either the top or bottom of center sheave 82.

Upper and lower wire payoff sheaves 104 and 106 are respectively disposed at the upper and lower ends of vertical post 86. More specifically, upper and lower payoff sheaves 104 and 106 are mounted respectively to upper and lower brackets 110 and 112 which, in turn, are rotatably mounted to the ends of vertical post 86. In this way, the tensioned wire 12 can be payed off from the upper or lower payoff sheaves 104 and 106 at an angle which is tangential to the wall of the concrete structure 14. Depending upon whether the concrete structure 14 is to be wrapped at a level above or below the height of the carriage 34, the tensioned wire 12 will be directed partially around direction sheave 92, partially around center sheave 94 and directed to either the upper wire payoff sheave 104 or the lower wire payoff sheave 106. The vertical post 86 may be hollow so that the wire from center sheave 94 passes through the post to either the upper payoff sheave or the lower payoff sheave.

A plurality of wheels 114 are rotatably mounted on carriage 34, and, in operation, these wheels contact the wall of structure 14 to facilitate movement of the carriage along the structure. A drive sprocket 116 is rotatably mounted on carriage 34 and engages chain 50 to help move the carriage along that chain and along the structure 14; and a plurality of sprocket gears 120, 122, 124, 126, 130 and 132 are also rotatably mounted on carriage 34 and engage chain 50 to help guide the carriage across the chain.

Preferably, a drive motor 134 is also mounted on carriage 34, and this motor is connected through coupler 136 to a right angle gear box 140. Gear box 140 has an output shaft 142 which is coupled to shaft 144, on which drive sprocket 116 is mounted. Shafts 142 and 144 are connected to gear box 146 which has an input shaft 150 that rotates at a proportionately increased speed compared to that of drive sprocket shaft 144. Input shaft 150 of gear box 146 is connected via coupler 152 to an output shaft 154 of slip clutch 156. Input shaft 160 of slip clutch 156 is connected via coupler 162 to output shaft 164 of speed-increasing gear box 166, and input shaft 170 of speed-increasing gear box 166 is coupled via coupler 172 to stress wheel shaft 70. Speed increasing gear box 166 produces an increased rotational speed of input shaft 160 of slip clutch 156, and gear box 146 similarly produces an increased rotational speed of the output shaft 154 of the slip clutch. Because of this, the frictional forces developed in the slip clutch are maintained in a preferred range, and thus are more accurately controlled.

The driving force which propels the carriage 34 about the periphery of the concrete structure 14 is a combination of the tension on the wire 12 and the motor 134, although most of the driving force is generated by the tension in the wire 12. Torque produced by the stress in the tensioned wire is transmitted through the slip clutch 156 to gear box 146 and drive sprocket shaft 144. This torque is supplemented by driving motor 134 through right angle gear box 140 and its associated coupling shaft 142.

Figure 6:
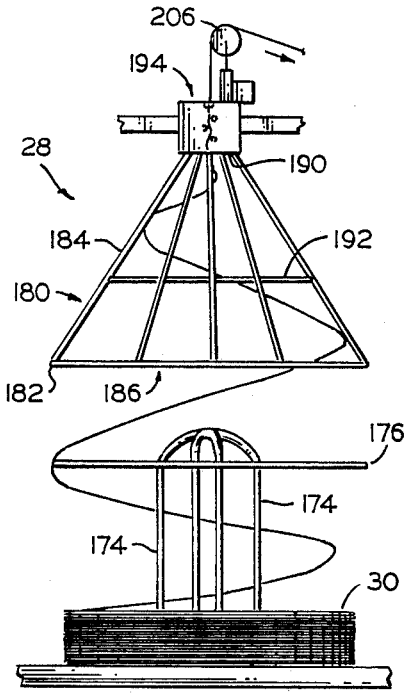
FIG. 6 is an elevational view of a wire supply payoff device used on the wire tensioning means.

FIG. 6 shows a wire supply payoff device 28; and with this device, a supply of wire 30, preferably a wire spool, is placed on a spindle section which includes vertical spindle posts 174 and bonnet 176. Posts 174 are joined to each other at their tops, and bonnet 176 is a horizontally disposed circular ring that is connected via brackets (not shown) or the like to the upper portion of vertical spindle 174. A conically shaped basket 180 is vertically disposed above the spindle section of the wire supply payoff means, and preferably basket 180 comprises a lower horizontal circular ring 182 and support members 184. Ring 182 is approximately the same size as bonnet 176 and defines an inlet opening 186 to receive the wire from the wire supply 30, and support members 184 are attached to lower basket ring 182 and converge to define a wire outlet opening 190, which is smaller in diameter than the inlet opening 186. The basket may also include cross supports 192 attached transversally to supports 184. In use, untensioned wire is vertically unwound from wire supply 30, is passed around the outside of bonnet 176 and enters basket 180, and the wire passes through the interior of the basket and exits therefrom via outlet 190.

Figure 7:
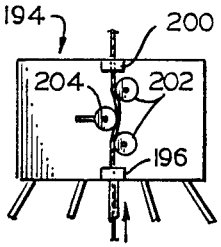
FIG. 7 is an expanded view in elevation of a portion of FIG. 6.
Figure 8:
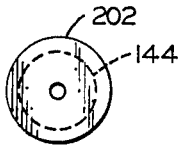
FIGS. 8 and 9 are respectively front and side views of a killer wheel of the wire supply payoff device.
Figure 9:
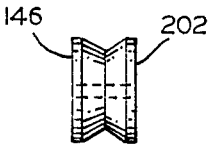

From outlet 190, the wire 12 passes through killer wheel assembly 194, which is attached to support members 184 above outlet 190. FIGS. 7–9 show details of the killer wheels assembly 194; and generally this assembly includes an entrance guide 196, an exit guide 200, two outer killer wheels 202 and a center killer wheel 204. Center killer wheel 204 is adjustably mounted in relation to the outer killer wheels 202 so that the wire 12 is slightly deflected as it passes between wheels 202 and 204. This action removes any bends or kinks in the wire as it unwraps from the spool and enter basket 180. Killer wheels 204 and 202 also provide an adjustable back tension to the wire 12, which, in theory, is necessary to prevent the wire from slipping or unraveling from the stress wheels. This back tension can be adjusted by changing the distance the killer wheels 204 and 202 are offset from each other. As shown in FIG. 6, the wire 12 passes from killer wheel assembly 194, through exit guide 200 and then over sheave 206. Attached to sheave 206 is a spring 210 and sensing device 212, which automatically stops movement of the carriage 34 or payout of the wire when any wire tangle, kink, or the like causes a certain downward deflection of sheave 206.

Before or during the tensioning of wire 12, it is possible that tiny flaws such as voids, holes, fissures or the like may be formed in wire coating **12*b*; and as previously mentioned, flaw detecting means 20 is provided to receive the tensioned portion of the wire from tensioning means 16**, and to sense or detect such flaws in the wire coating along the tensioned portion of the wire. These flaws or imperfections in the coating are commonly known as "holidays," and there are many types of holiday detector devices which have been developed for inspecting wire covers or coatings, and any suitable holiday detector may be used in the practice of this invention.

The specific embodiment of flaw detecting means 20 illustrated in FIG. 1 includes applicator means 214 and electric circuit 216. Applicator means 214 applies an electrically conductive liquid to wire coating **12*b*, and the applicator may be a sponge soaked in any suitable electrically conductive liguid. With reference to FIG. 1*b*, applicator means 214 directly engages the tensioned portion of wire 12; and, for instance, the applicator means may be held against the wire coating 12*b***, or the wire may be passed through the applicator means.

Electric circuit 216 is connected to applicator means 214 and to inner core **12*a* of wire 12, specifically to the very end thereof, to maintain an electric potential difference between the wire core and the applicator means. For instance, electric circuit 216 may comprise any suitable direct current battery having plus and minus voltage terminals, with the minus terminal connected to applicator means 214 via line 220, and with the positive terminal connected to the end of wire core 12*a* via line 222. With this arrangement, the electric circuit is normally nonconductive because wire coating 12*b* electrically separates core 12*a* from applicator means 214**, thus acting as an open switch in the electric circuit.

However, when a hole, fissure or similar defect in the wire coating **12*b* moves into contact with applicator means 214, the conductive liquid on or in the applicator means passes through the defect in the wire coating and forms an electrical bridge between the wire core and the applicator means, rendering circuit 216 electrically conductive. After the defect in the wire coating has moved completely past the applicator means, this electrical bridge is broken or opened, returning the electric circuit to its normally non-conductive state. A signal light 224** or other suitable alarm may be located in the electric circuit to provide a visual or audible signal when the electric circuit is conductive and to thereby indicate the presence of a defect or flaw in the portion of the wire coating in contact with the applicator means.

Recording means 22 is connected to flaw detecting means 20 to record the location of defects in the wire coating; and, as illustrated in FIG. 1, the recording means may comprise recorder 84, event marker 226 and electro-magnet 230. Event marker 226 is part of strip chart recorder 84, and may comprise an electrically actuated marking device that, when actuated, simply marks chart **84*a*. Electro-magnet 230 is connected in parallel with electric circuit 216 and in series with event marker 226. Normally, electro-magnet 230 is open, and the electro-magnet closes when a current is conducted through circuit 216; when the electro-magnet closes, event marker 226 is actuated to mark chart 84*a*, making a permanent record of the location of the defects in wire coating 12*b*. Because the same chart 84*a*** is used both to record the tension on the wire and to record the location of defects in the wire coating, it is very easy for an operator to observe the tension on the wire at the locations where defects exist in the wire coating.

Also, with this permanent record of the flaws in the wire coating, it is relatively easy, if desired, to locate and fix a flaw, either immediately or soon after detecting the flaw, or at a subsequent time such as after a wire band has been completely wrapped around structure 14. For instance, a defect in wire coating **12*b* can be fixed after a wire band has been wrapped onto structure 14 by pulling and holding away from the structure the portion of the wire having the coating defect, applying an epoxy over that defect and allowing the epoxy to cure to thereby fill or fix the defect. Care should be taken to avoid damaging the wire as it is being fixed; and once the defect is corrected, this wire portion can be returned to a position in direct pressure engagement against structure 14**.

Wire marking means 24 is located adjacent the tensioned portion of wire 12 and is connected to flaw detecting means 20 to mark the wire coating adjacent the flaws therein. Any suitable wire marking means may be employed to carry out this preferred embodiment of the invention; and, for instance, marking means 24 may comprise a conventional electrically operated paint sprayer electrically connected in parallel with electric circuit 216. Whenever a flaw in wire coating **12*b* moves into contact with applicator means 214 so as to render circuit 216 conductive, sprayer 24** is also actuated to spray a quantity of paint onto the wire coating at or near that flaw, providing a permanent mark on the wire itself to identify the location of the flaw.

If desired, delay means (not shown) may be connected to marking means 24 to delay the actuation of the marking means for a preset length of time after circuit 216 becomes conductive. This preset length of time may be selected so that the flaw in the wire coating that caused circuit 216 to become conductive is directly forward of marking means 24 when this means is actuated. In this way, the flaw itself, or a portion of the wire coating immediately adjacent the flaw, is directly marked by the marking means. Suitable resistors are located in series with alarm 224, electromagnet 230 and marking means 24 to insure that the currents conducted through these devices are maintained within preferred levels. Flaw detecting means 20, recording means 22 and wire marking means 24 may be connected to wire tensioning means 16 in any suitable way for movement therewith around structure 14, and for example, the flaw detecting means and the recording means may be supported on carriage 34. If desired, however, detecting means 20, recording means 22 and marking means 24 may be supported independent of tensioning means 16 for movement around structure 14.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. Apparatus for winding a wire around a periphery of a structure, the wire having an internal core and an outer coating, the apparatus comprising:

tensioning means to tension wire from a wire supply, the tensioning means including means for holding the wire supply, means for stressing the wire, and means for driving the tensioning means around the periphery of the structure, the tensioning means being adapted to separate the wire into a lower tension portion extending between the wire supply and the stressing means and a higher tension portion extending between the stressing means and the structure;

flaw detecting means to receive and engage the higher tension portion of the wire from the tensioning means and to sense flaws in the wire coating along said higher tension portion; and recording means connected to the flaw detecting means to record the location of the flaws in the wire coating.

2. Apparatus according to claim 1, further including wire marking means located adjacent the higher tension portion of the wire and connected to the flaw detecting means to mark the wire coating adjacent the flaws therein.

3. Apparatus according to claim 2, wherein the flaw detecting means includes:

applicator means to apply a conductive liquid to the wire coating; and an electric circuit electrically connected to the inner core of the wire and to the applicator means to maintain an electric voltage difference between the wire coating and the applicator means.

4. Apparatus according to claim 3, wherein:

the electric circuit has a nonconductive state and a conductive state;

the electric circuit is normally in the nonconductive state and changes therefrom to the conductive state when the conductive liquid passes through a flaw in the wire coating and conducts electric current between the applicator means and the wire core;

the wire marking means includes an electrically actuated spraying means; and the electric circuit actuates the spraying means to spray a material onto the wire coating adjacent a flaw therein when the electric circuit is in the conductive state.

5. Apparatus according to claim 3, wherein:

the application means comprises a sponge soaked in the electrically conductive liquid; and the sponge is adapted to pass the wire through the interior of the sponge.

6. Apparatus according to claim 1, further including:

tension measuring means engaging the higher tension portion of the wire to measure the tension thereof; and tension recording means connected to the tension measuring means, to record the measured tension.

7. Apparatus according to claim 6, wherein:

the means to record the measured tension includes (i) a chart having an axis representing the length of the wire, and (ii) means to record on the chart the tension of the wire, the tension of the wire at a position along the length thereof being recorded on the chart at a position along said axis corresponding to said position on the wire; and the means to record the location of the flaws includes means to mark the chart at positions along the axis thereof corresponding to the positions of the flaws along the length of the wire.

8. Apparatus according to claim 1, wherein the flow detecting means is connected to the tensioning means for movement therewith around the structure.

9. A method for winding a wire around a structure, the wire having an internal core and an outer coating, the method comprising the steps of:

connecting the wire to the structure;

pulling the wire around the structure to produce a high tension in a portion of the wire and to wind said high tension portion of the wire around the structure;

engaging the high tension portion of the wire with a flaw detector to detect flaws in the wire coating along the high tension portion of the wire as said high tension portion is being wound around the structure; and recording the locations of said flaws.

10. A method according to claim 9, further including the step of marking the wire coating adjacent the flaws therein.

11. A method according to claim 10, further including the steps of:

measuring the tension on the high tension portion of the wire; and recording the measured tension on a chart having an axis representing the length of the wire, the tension of the wire at a position along the length thereof being recorded on the chart at a position along said axis corresponding to said position on the wire.

12. A method according to claim 11 wherein the step of recording the locations of said flaws includes the step of marking the chart at positions along the axis thereof corresponding to the positions of the flaws along the length of the wire.

13. A method according to claim 9, further comprising the step of fixing the flaws in the wire coating after the wire has been wound around the structure.

14. A method according to claim 13, wherein:

the recording step includes the step of making a record of the locations of the flaws in the wire coating; and the fixing step includes the step of using said record to find the flaws in the wire coating after the wire has been wound onto the structure.

* * * * *